US009972294B1

(12) United States Patent
Tcheng

(10) Patent No.: US 9,972,294 B1
(45) **Date of Patent: *May 15, 2018**

(54) SYSTEMS AND METHODS FOR AUDIO BASED SYNCHRONIZATION USING SOUND HARMONICS

(71) Applicant: GOPRO, INC., San Mateo, CA (US)

(72) Inventor: David Tcheng, San Mateo, CA (US)

(73) Assignee: GoPro, Inc., San Mateo, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/458,714

(22) Filed: Mar. 14, 2017

Related U.S. Application Data

(63) Continuation of application No. 15/247,273, filed on Aug. 25, 2016, now Pat. No. 9,640,159.

(51) Int. Cl.
*A63H 5/00* (2006.01)
*G04B 13/00* (2006.01)
*G10H 1/00* (2006.01)

(52) U.S. Cl.
CPC ..... *G10H 1/0008* (2013.01); *G10H 2240/325* (2013.01); *G10H 2250/215* (2013.01); *G10H 2250/261* (2013.01)

(58) Field of Classification Search
CPC ..... G10H 1/0008; G10H 2210/066; G10H 2240/325; G10H 2250/215
USPC ..... 84/609
See application file for complete search history.

(56) References Cited

U.S. PATENT DOCUMENTS 5,175,769 A * 12/1992 Hejna, Jr. ..... G10L 21/04 704/211
6,564,182 B1 5/2003 Gao
7,012,183 B2 3/2006 Herre
7,256,340 B2 8/2007 Okazaki
7,301,092 B1 11/2007 McNally et al.
7,461,002 B2 * 12/2008 Crockett ..... G10L 21/04 704/200.1
7,521,622 B1 4/2009 Zhang
7,593,847 B2 9/2009 Oh
7,619,155 B2 11/2009 Teo
7,672,836 B2 3/2010 Lee
7,745,718 B2 6/2010 Makino
7,767,897 B2 8/2010 Jochelson
7,863,513 B2 1/2011 Ishii
7,985,917 B2 7/2011 Morris
8,101,845 B2 1/2012 Kobayashi
8,111,326 B1 2/2012 Talwar
8,179,475 B2 * 5/2012 Sandrew ..... G11B 27/10 348/515

(Continued)

*Primary Examiner* — Jeffrey Donels
(74) *Attorney, Agent, or Firm* — Sheppard Mullin Richter & Hampton LLP

(57) ABSTRACT

Multiple audio files may be synchronized using harmonic sound included in audio content obtained from audio tracks. Individual audio tracks are partitioned into multiple temporal windows of a first and second temporal window length. Individual audio waveforms for individual temporal windows of the first and second window length are transformed into frequency space in which energy is represented as a function of frequency. Individual pitches and magnitudes of harmonic sound determined for individual temporal windows may be compared using a multi-resolution framework to correlate pitches and harmonic energy of multiple audio tracks to one another.

20 Claims, 6 Drawing Sheets

(56) References Cited

U.S. PATENT DOCUMENTS

| | | | | |
|---|---|---|---|---|
| 8,193,436 | B2 | 6/2012 | Sim | |
| 8,205,148 | B1 | 6/2012 | Sharpe | |
| 8,223,978 | B2 | 7/2012 | Yoshizawa | |
| 8,378,198 | B2 | 2/2013 | Cho | |
| 8,411,767 | B2 | 4/2013 | Alexander | |
| 8,428,270 | B2 * | 4/2013 | Crockett | H03G 3/3089 381/102 |
| 8,497,417 | B2 | 7/2013 | Lyon | |
| 8,785,760 | B2 | 7/2014 | Serletic | |
| 8,964,865 | B2 | 2/2015 | Alexander | |
| 9,031,244 | B2 | 5/2015 | Lang | |
| 9,418,643 | B2 | 8/2016 | Eronen | |
| 2002/0133499 | A1 | 9/2002 | Ward | |
| 2003/0033152 | A1 | 2/2003 | Cameron | |
| 2004/0083097 | A1 | 4/2004 | Chu | |
| 2004/0094019 | A1 | 5/2004 | Herre | |
| 2004/0148159 | A1 * | 7/2004 | Crockett | G10L 21/04 704/211 |
| 2004/0165730 | A1 * | 8/2004 | Crockett | G10L 15/04 381/56 |
| 2004/0172240 | A1 * | 9/2004 | Crockett | G10L 25/48 704/205 |
| 2004/0254660 | A1 | 12/2004 | Seefeldt | |
| 2004/0264561 | A1 | 12/2004 | Alexander | |
| 2005/0021325 | A1 | 1/2005 | Seo | |
| 2005/0091045 | A1 | 4/2005 | Oh | |
| 2005/0234366 | A1 | 10/2005 | Heinz | |
| 2006/0021494 | A1 | 2/2006 | Teo | |
| 2006/0080088 | A1 | 4/2006 | Lee | |
| 2006/0107823 | A1 | 5/2006 | Platt | |
| 2007/0055503 | A1 | 3/2007 | Chu | |
| 2007/0055504 | A1 | 3/2007 | Chu | |
| 2007/0061135 | A1 | 3/2007 | Chu | |
| 2007/0163425 | A1 | 7/2007 | Tsui | |
| 2007/0240556 | A1 | 10/2007 | Okazaki | |
| 2008/0148924 | A1 | 6/2008 | Tsui | |
| 2008/0219637 | A1 | 9/2008 | Sandrew | |
| 2008/0304672 | A1 | 12/2008 | Yoshizawa | |
| 2008/0317150 | A1 | 12/2008 | Alexander | |
| 2009/0049979 | A1 * | 2/2009 | Naik | G10H 1/40 84/636 |
| 2009/0056526 | A1 | 3/2009 | Yamashita | |
| 2009/0170458 | A1 | 7/2009 | Molisch | |
| 2009/0217806 | A1 | 9/2009 | Makino | |
| 2009/0287323 | A1 | 11/2009 | Kobayashi | |
| 2010/0257994 | A1 * | 10/2010 | Hufford | G10H 1/0025 84/609 |
| 2011/0167989 | A1 | 7/2011 | Cho | |
| 2012/0103166 | A1 | 5/2012 | Shibuya | |
| 2012/0127831 | A1 | 5/2012 | Gicklhorn | |
| 2012/0297959 | A1 | 11/2012 | Serletic | |
| 2013/0025437 | A1 | 1/2013 | Serletic | |
| 2013/0201972 | A1 | 8/2013 | Alexander | |
| 2013/0220102 | A1 | 8/2013 | Savo | |
| 2013/0304243 | A1 | 11/2013 | Iseli | |
| 2013/0339035 | A1 | 12/2013 | Chordia | |
| 2014/0053710 | A1 | 2/2014 | Serletic, II | |
| 2014/0053711 | A1 | 2/2014 | Serletic, II | |
| 2014/0067385 | A1 | 3/2014 | Oliveira | |
| 2014/0123836 | A1 | 5/2014 | Vorobyev | |
| 2014/0180637 | A1 | 6/2014 | Kerrigan | |
| 2014/0307878 | A1 | 10/2014 | Osborne | |
| 2015/0279427 | A1 | 10/2015 | Godfrey | |
| 2016/0192846 | A1 | 7/2016 | Shekhar | |
| 2016/0212306 | A1 | 7/2016 | Kawa | |

* cited by examiner

SYSTEMS AND METHODS FOR AUDIO BASED SYNCHRONIZATION USING SOUND HARMONICS

FIELD OF THE INVENTION

The disclosure relates to synchronizing multiple audio tracks using harmonics of the harmonic sound.

BACKGROUND OF THE INVENTION

Multiple media recordings may be generated during the same live occurrence. The media recordings obtained from multiple media capture devices during the same live occurrence may be synchronized using harmonics of the harmonic sound of the media recordings. Harmonics may be generated from an audio track in a frequency space in which energy may be represented as a function of frequency.

SUMMARY

One or more aspects of the present disclosure relate to a synchronization of multiple media files using harmonics of the harmonic sound. Harmonics may include pitch of the harmonic sound, harmonic energy, and/or other features. For example, transformed representation may be used to obtain one or more of pitch of the harmonic sound, harmonic energy of individual temporal windows partitioning an audio track, and/or other information. One or more transformed representations of one or more temporal windows of one or more temporal window lengths of one or more audio tracks may be compared to correlate pitch of the harmonic sound and harmonic energy of individual temporal windows to one another. The results of the correlation may be used to determine a temporal offset between multiple audio tracks. The temporal offset may be used to synchronize multiple audio tracks.

In some implementations, a system configured to synchronize multiple media files using harmonics of the harmonic sound may include one or more servers and/or other components. Server(s) may be configured to communicate with one or more client computing platforms according to a client/server architecture and/or other communication schemes. The users of the system may access the system via client computing platform(s). Server(s) may be configured to execute one or more computer program components. The computer program components may include one or more of an audio track component, a temporal window component, a transformation component, a pitch component, a harmonics component, a temporal alignment component, a synchronizing component, and/or other components.

A repository of media files may be available via the system (e.g., via an electronic storage and/or other storage location). The repository of media files may be associated with different users. In some implementations, the system and/or server(s) may be configured for various types of media files that may include video files that include audio content, audio files, and/or other types of files that include some audio content. Other types of media items may include one or more of audio files (e.g., music, podcasts, audio books, and/or other audio files), multimedia presentations, photos, slideshows, and/or other media files. The media files may be received from one or more storage locations associated with client computing platform(s), server(s), and/or other storage locations where media files may be stored. Client computing platform(s) may include one or more of a cellular telephone, a smartphone, a digital camera, a laptop, a tablet computer, a desktop computer, a television set-top box, a smart TV, a gaming console, and/or other client computing platforms. In some implementations, the plurality of media files may include audio files that may not contain video content.

The audio track component may be configured to obtain one or more audio tracks from one or more media files. By way of non-limiting illustration, a first audio track and/or other audio tracks may be obtained from a first media file and/or other media files. The audio track component may be configured to obtain a second audio track from a second media file. The first media file and the second media file may be available within the repository of media files available via the system and/or available on a third party platform, which may be accessible and/or available via the system.

One or more of the first media file, the second media file, and/or other media files may be media files captured by the same user via one or more client computing platform(s) and/or may be media files captured by other users. In some implementations, the first media file, the second media file, and/or other media files may be of the same live occurrence. As one example, the files may include files of the same event, such as videos of one or more of a sporting event, concert, wedding, and/or events taken from various perspectives by different users. In some implementations, the first media file, the second media file, and/or other media files may not be of the same live occurrence but may be of the same content. For example, the first media file may be a user-recorded file of a song performance and the second media file may be the same song performance by a professional artist.

The audio track component may be configured to obtain audio tracks from media files by extracting audio signals from media files, and/or by other techniques. By way of non-limiting illustration, the audio track component may be configured to obtain the first audio track by extracting audio signal from the first media file. The audio track component may be configured to obtain the second audio track by extracting an audio signal from the second media file. For example and referring to FIG. 2, an audio track may contain audio information. Audio information may contain harmonic sound information representing a harmonic sound which may be graphically visualized as waveform of sound pressure as a function of time. The sound wave's amplitude is mapped on the vertical axis with time on the horizontal axis. Thus, the audio information contained within a media file may be extracted in the form of an audio track. Individual audio tracks may be synchronized with one another by comparing similarities between their corresponding sound wave information.

Referring back to FIG. 1, in some implementations, audio track component 106 may be configured to extract audio signals from one or more media files associated with one or more frequency by applying one or more frequency bandpass filters. For example, a frequency bandpass filter applied to the media file may extract audio signal having frequencies between 1000 Hz and 5000 Hz.

The temporal window component may be configured to obtain one or more temporal window length values. The temporal window component may be configured to obtain one or more temporal window length values of different temporal window lengths. Temporal window length value may refer to a portion of an audio track duration. Temporal window length value may be expressed in time units including seconds, milliseconds, and/or other units. The temporal window component may be configured to obtain temporal window length values that may include a temporal window length generated by a user, a randomly generated temporal window length, and/or otherwise obtained. By way of non-limiting illustration, a first temporal window length may be obtained. The temporal window component may be configured to obtain a second temporal window length.

The temporal window component may be configured to partition one or more audio track durations of one or more audio tracks into multiple temporal windows of one or more temporal window lengths. Individual temporal windows of may span the entirety of the audio track comprised of harmonic sound information obtained via the audio track component from the audio wave content of one or more audio tracks. By way of non-limiting illustration, the first audio track may be partitioned into multiple temporal windows of the first temporal window length and of the second temporal windows length. The temporal window component may be configured to partition the second audio track into multiple temporal windows of the first temporal window length and of the second temporal windows length.

The transformation component may be configured to determine one or more transformed representations of one or more audio tracks by transforming one or more audio energy tracks for one or more temporal windows into a frequency space in which energy may be represented as a function of frequency to generate a harmonic energy spectrum of the one or more audio tracks. By way of non-limiting illustration, a first transformed representation of the first audio track may be determined by transforming one or more temporal windows of the first temporal window length. The transformation component may be configured to determine a second transformed representation of the first audio track by transforming one or more temporal windows of the second temporal window length. The transformation component may be configured to determine a third transformed representation of the second audio track by transforming one or more temporal windows of the second temporal window length. The transformation component may be configured to determine a fourth transformed representation of the second audio track by transforming one or more temporal windows of the second temporal window length. As illustrated in FIG. 2, waveform of a sound wave of an audio track may be transformed to generate a harmonic spectrum. A harmonic spectrum graph tracks one or more of frequency, and/or energy of sound in an audio track. The horizontal direction of the harmonic spectrum represents multiples of fundamental frequency, the vertical direction represents energy. One or more differences between individual one or more multiples of fundamental frequencies may be identified as pitch of the harmonic sound.

Referring back to FIG. 1, individual transformed representations for individual temporal windows may be presented as a harmonic spectrum (e.g., an energy-frequency representation) where multiples of fundamental frequencies associated with the transformed signal may be viewed as peaks on the horizontal axis and the corresponding energy on the vertical axis. A frequency associated with a highest energy level may be referred to as a fundamental frequency or a first harmonic of harmonic sound. By way of non-limiting illustration, a first harmonic and a second harmonic of the harmonic sound of one or more transformed representations of one or more temporal windows of one or more temporal window lengths of one or more audio tracks may be determined.

The pitch component may be configured to identify one or more pitches of the harmonic sound of one or more transformed representations for individual temporal windows of one or more temporal window length. By way of non-limiting illustration, a first pitch of the first transformed representation of one or more temporal windows of the first temporal window length of the first audio track may be identified. The pitch component may be configured to determine a second pitch of the second transformed representation of one or more temporal windows of the second temporal window length of the first audio track. The pitch component may be configured to determine a third pitch of the third transformed representation of one or more temporal windows of the first temporal window length of the second audio track. The pitch component may be configured to determine a fourth pitch of the fourth transformed representation of one or more temporal windows of the second temporal window length of the first audio track.

The harmonic energy component may be configured to determine magnitudes of harmonic energy at harmonics of the harmonic sound in one or more transformed representations for individual temporal windows of individual temporal window lengths of one or more audio tracks. Individual magnitudes of harmonic energy may be determined for the first harmonic and the second harmonic for individual temporal windows of individual temporal window lengths. A total magnitude of harmonic energy for individual temporal windows may be determined by finding an average of individual magnitudes, a sum of individual magnitudes, and/or otherwise determined. By way of non-limiting illustration, a first magnitude of harmonic energy may be determined for the first transformed representation of one or more temporal windows of the first temporal window length of the first audio track may be determined. The harmonic energy component may be configured to determine a second magnitude of harmonic energy of the second transformed representation of one or more temporal windows of the second temporal window length of the first audio track. The harmonic energy component may be configured to determine a third magnitude of harmonic energy of the third transformed representation of one or more temporal windows of the first temporal window length of the second audio track. The harmonic energy component may be configured to determine a fourth magnitude of harmonic energy of the fourth transformed representation of one or more temporal windows of the second temporal window length of the second audio track.

The comparison component may be configured to compare one or more transformed representations of one or more temporal windows of one or more temporal window length of one or more audio tracks. Specifically, the comparison component may be configured to correlate pitch of the harmonic sound and harmonic energy of one or more temporal windows of one or more audio tracks. By way of non-limiting illustration, the first transformed representation of one or more temporal windows of the first temporal window length of the first audio track may be compared against the third transformed representation of one or more temporal windows of the first temporal window length of the second audio track to correlate individual pitch of the harmonic sound and harmonic energy of individual temporal windows.

The process performed by the comparison component may be performed iteratively until a result of such comparison is determined. For example, after comparing individual transformed representation of individual temporal windows at the first temporal window length of the first audio track against individual transformed representations of individual temporal windows at the first temporal window length of the second audio track, multiple correlation results may be obtained. The correlation results may be transmitted to the system and a determination for the most accurate result may be made.

In some implementations, based on the results obtained from comparing audio tracks at a certain temporal window length, the comparison component may be configured to compare one or more transformed representations of one or more temporal windows of the second temporal window length of one or more audio tracks.

The process performed by the comparison component for the second temporal window length may be performed iteratively until a result of such comparison is determined. For example, after comparing individual transformed representation of individual temporal windows at the second temporal window length of the first audio track against individual transformed representations of individual temporal windows at the second temporal window length of the second audio track, multiple correlation results may be obtained. The correlation results may be transmitted to the system and a determination for the most accurate result may be made.

In various implementations, the comparison component may be configured to apply one or more constraint parameter to control the comparison process. The comparison constraint parameters may include one or more of limiting comparison time, limiting the energy portion, limiting frequency bands, limiting the number of comparison iterations and/or other constrains.

The comparison component may be configured to determine the time it took to compare the first transformed representation of the first audio track against the first transformed representation of the second audio track at the first temporal window length. Time taken to correlate pitch of the harmonic sound and harmonic energy of individual temporal windows of the first audio track against pitch of the harmonic sound and harmonic energy of individual temporal windows of the second audio track may be transmitted to the system. The comparison component may utilize the time taken to correlate pitch of the harmonic sound and harmonic energy of individual temporal windows at a particular temporal window length in subsequent comparison iterations. For example, time taken to compare transformed representations at a longer temporal window length may be equal to 5 seconds. The comparison component may be configured to limit the next comparison iteration at a smaller temporal window length to 5 seconds. In one implementation, the time taken to compare two transformed representations may be utilized by the other constraint comparison parameters and/or used as a constant value.

The comparison component may be configured to limit the audio track duration of one or more audio tracks during the comparison process by applying a comparison window set by a comparison window parameter. The comparison component 116 may be configured to limit the audio track duration of one or more audio track being compared by applying the comparison window parameter (i.e., by setting a comparison window). The comparison window parameter may include a time of audio track duration to which the comparison may be limited, a position of the comparison window, including a start position and an end position, and/or other constrains. This value may be predetermined by the system, set by a user, and/or otherwise obtained.

In some implementation, the comparison component may be configured to limit the audio track duration such that the comparison window parameter may not be greater than 50 percent of the audio track duration. For example, if an audio track is 500 seconds then the length of the comparison window set by the comparison window parameter may not be greater than 250 seconds.

The comparison window parameter may have a predetermined start position that may be generated by the system and/or may be based on user input. The system may generate a start position of the comparison window based on the audio track duration. For example, the start position may be randomly set to the initial one third of the audio track duration. In some implementations, the user may generate the start position of the comparison window based on specific audio features of the audio track. For example, user may know that a first audio track and a second audio track may contain audio features that represent sound captured at the same football game, specifically first touchdown of the game. Audio features associated with the touchdown may be used to generate the start position of the comparison window.

The comparison component may be configured to limit one or more portions of one or more audio track during the comparison process based on the comparison window parameter during every comparison iteration. The comparison component may be configured to limit the comparison process to the same portion of one or more audio tracks. Alternatively, in some implementations, the comparison component may be configured to limit the comparison process to different portions of one or more audio tracks based on the comparison window parameter during individual comparison iteration. For example, the comparison window parameter may be generated every time the comparison of the audio tracks at a specific temporal window length is performed. In other words, the start position of the comparison window parameter may be different with every comparison iteration irrespective of the start position of the comparison window parameter at the previous resolution level.

The comparison component may be configured to limit the number of comparison iterations based on a correlation threshold parameter. The comparison component may be configured to generate a correlation coefficient based on a result of a first comparison that may identify correlated pitch of the harmonic sound and harmonic energy of individual temporal windows. The comparison component 116 may be configured to obtain a threshold value. The threshold value may be generated by the system, may be set by a user, and/or obtained by other means. The comparison component may be configured to compare the correlation coefficient against the threshold value. The comparison component may be configured to stop the comparison when the correlation coefficient falls below the threshold value.

In some implementations, the comparison component may be configured to compare pitch of the harmonic sound and harmonic energy of individual temporal windows of the first audio track against pitch of the harmonic sound and harmonic energy of individual temporal windows of the second audio track within the multi-resolution framework, which is incorporated by reference.

The second comparison may be performed at a level of resolution that may be higher than the mid-resolution level. Pitch of the harmonic sound and harmonic energy of individual temporal windows of the first audio track of the first energy track at the higher resolution level may be compared against pitch of the harmonic sound and harmonic energy of individual temporal windows of the first audio track of the second energy track at the higher resolution level. The result of the second comparison may be transmitted to the system.

This process may be iterative such that the comparison component may compare pitch of the harmonic sound and harmonic energy of individual temporal windows of the first audio track against pitch of the harmonic sound and harmonic energy of individual temporal windows of the first audio track of the second energy track at every resolution level whereby increasing the resolution with individual iteration until the highest level of resolution is reached. For example, if the number of resolution levels within individual energy track is finite, the comparison component may be configured to compare transformed representations at a mid-resolution level first, then, at next iteration, the comparison component may be configured to compare frequency energy resolutions at a resolution level higher than the resolution level of previous iteration, and so on. The last iteration may be performed at the highest resolution level. The system may accumulate a number of transmitted correlation results obtained from the comparison component. The correlation results may be transmitted to the system and a determination for the most accurate result may be made.

The temporal alignment component may be configured to determine a temporal alignment estimate between multiple audio tracks. By way of non-limiting illustration, the temporal alignment component may be configured to determine a temporal alignment estimate between multiple audio tracks based on the results of comparing one or more transformed representation generated by the transformation component via the comparison component to correlate pitch of the harmonic sound identified by the pitch component and harmonic energy determined by the harmonics component of individual temporal windows, and/or based on other techniques. The temporal alignment estimate may reflect an offset in time between a commencement of sound on one or more audio tracks.

The temporal alignment component may be configured to identify matching pitch of the harmonic sound and harmonic energy of transformed representations of one or more temporal windows of individual temporal windows length of individual audio tracks. The temporal alignment component may identify matching pitch of the harmonic sound and harmonic energy from individual comparison iteration via the comparison component. The temporal alignment component may be configured to calculate a $\Delta t$, or time offset value, based on a position of the matching energy samples within the corresponding frequency energy representations.

In some implementations, the temporal alignment component may be configured to determine multiple temporal alignment estimates between the first audio track and the second audio track. Individual temporal alignment estimates may be based on comparing individual transformed representations of one or more temporal windows of individual audio tracks via the comparison component, as described above. The temporal alignment component may be configured to assign a weight to individual temporal alignment estimates. The temporal alignment component may be configured to determine a final temporal alignment estimate by computing weighted averages of multiple temporal alignment estimates and/or by performing other computations.

In some implementations, the temporal alignment component may be configured to use individual playback rates associated with individual audio tracks when determining the temporal alignment estimate. Using individual playback rates as a factor in determining audio track alignment may correct a slight difference in sample clock rates associated with equipment on which audio tracks may have been recorded. For example, multiple individual temporal alignment estimates may be analyzed along with individual playback rates of each audio track. A final temporal alignment estimate may be computed by taking into account both individual temporal alignment estimates and playback rates and/or other factors. A liner correction approach and/or other approach may be taken.

The synchronizing component may be configured to synchronize one or more audio tracks. By way of non-limiting illustration, the synchronizing component may be configured to use comparison results obtained via the comparison component of comparing one or more transformed representations of one or more temporal windows of one or more audio tracks, and/or using other techniques. The synchronizing component may be configured to synchronize the first audio track with the second audio track based on the temporal alignment estimate. In some implementations, the time offset between the energy tracks may be used to synchronize individual audio tracks by aligning the audio tracks based on the time offset calculation.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
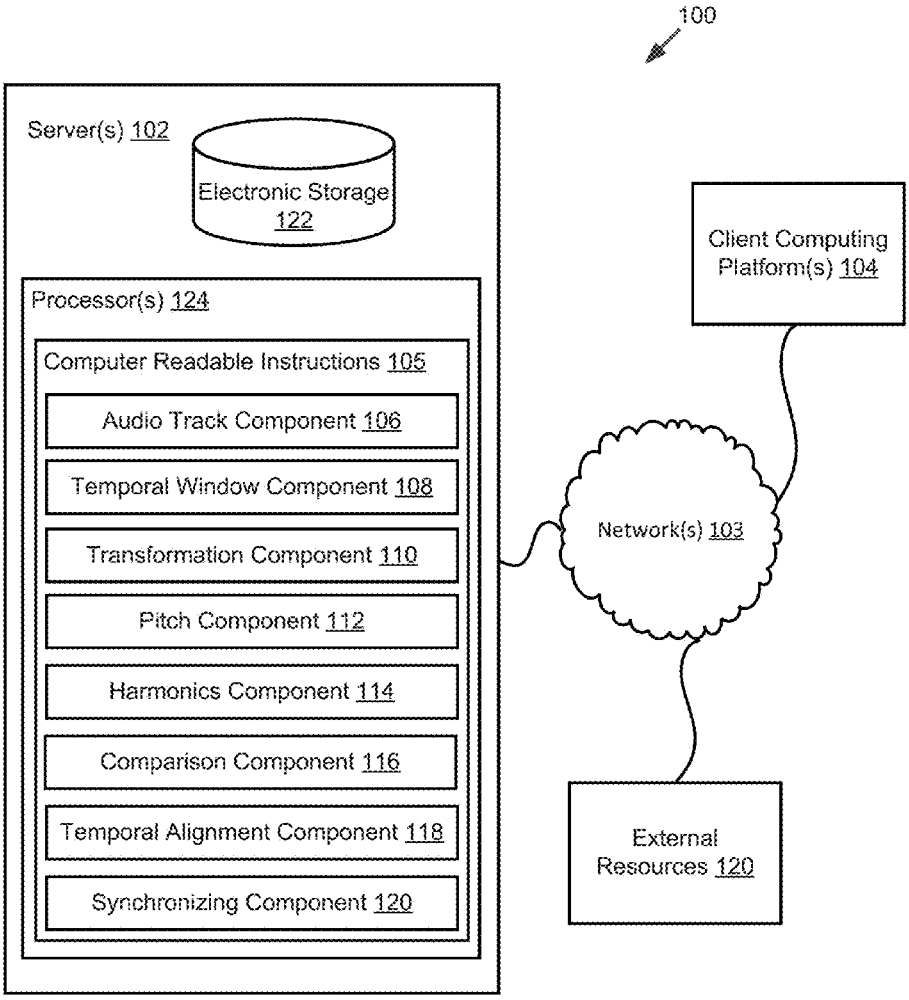
FIG. 1 illustrates a system for audio synchronization using harmonics of the harmonic sound, in accordance with one or more implementations.

FIG. 1 illustrates system 100 for audio synchronization using harmonics of the harmonic sound, in accordance with one or more implementations. As is illustrated in FIG. 1, system 100 may include one or more server(s) 102. Server(s) 102 may be configured to communicate with one or more client computing platforms 104 according to a client/server architecture. The users of system 100 may access system 100 via client computing platform(s) 104. Server(s) 102 may be configured to execute one or more computer program components. The computer program components may include one or more of audio track component 106, temporal window component 108, transformation component 110, pitch component 112, harmonics component 114, comparison component 116, temporal alignment component 118, synchronizing component 120, and/or other components.

A repository of media files may be available via system 100 (e.g., via electronic storage 122 and/or other storage location). The repository of media files may be associated with different users. In some implementations, system 100 and/or server(s) 102 may be configured for various types of media files that may include video files that include audio content, audio files, and/or other types of files that include some audio content. Other types of media items may include one or more of audio files (e.g., music, podcasts, audio books, and/or other audio files), multimedia presentations, photos, slideshows, and/or other media files. The media files may be received from one or more storage locations associated with client computing platform(s) 104, server(s) 102, and/or other storage locations where media files may be stored. Client computing platform(s) 104 may include one or more of a cellular telephone, a smartphone, a digital camera, a laptop, a tablet computer, a desktop computer, a television set-top box, a smart TV, a gaming console, and/or other client computing platforms. In some implementations, the plurality of media files may include audio files that may not contain video content.

Audio track component 106 may be configured to obtain one or more audio tracks from one or more media files. By way of non-limiting illustration, a first audio track and/or other audio tracks may be obtained from a first media file and/or other media files. Audio track component 106 may be configured to obtain a second audio track from a second media file. The first media file and the second media file may be available within the repository of media files available via system 100 and/or available on a third party platform, which may be accessible and/or available via system 100.

One or more of the first media file, the second media file, and/or other media files may be media files captured by the same user via one or more client computing platform(s) 104 and/or may be media files captured by other users. In some implementations, the first media file, the second media file, and/or other media files may be of the same live occurrence. As one example, the files may include files of the same event, such as videos of one or more of a sporting event, concert, wedding, and/or events taken from various perspectives by different users. In some implementations, the first media file, the second media file, and/or other media files may not be of the same live occurrence but may be of the same content. For example, the first media file may be a user-recorded file of a song performance and the second media file may be the same song performance by a professional artist.

Audio track component 106 may be configured to obtain audio tracks from media files by extracting audio signals from media files, and/or by other techniques. By way of non-limiting illustration, audio track component 106 may be configured to obtain the first audio track by extracting audio signal from the first media file. Audio track component 106 may be configured to obtain the second audio track by extracting an audio signal from the second media file. For example and referring to FIG. 2, audio track 202 may contain audio information. Audio information may contain harmonic sound information representing a harmonic sound which may be graphically visualized as waveform of sound pressure 250 as a function of time. The sound wave's amplitude is mapped on the vertical axis with time on the horizontal axis. Thus, the audio information contained within a media file may be extracted in the form of an audio track. Individual audio tracks may be synchronized with one another by comparing similarities between their corresponding sound wave information.

Referring back to FIG. 1, in some implementations, audio track component 106 may be configured to extract audio signals from one or more media files associated with one or more frequency by applying one or more frequency bandpass filters. For example, a frequency bandpass filter applied to the media file may extract audio signal having frequencies between 1000 Hz and 5000 Hz.

Temporal window component 108 may be configured to obtain one or more temporal window length values. Temporal window component 108 may be configured to obtain one or more temporal window length values of different temporal window lengths. Temporal window length value may refer to a portion of an audio track duration. Temporal window length value may be expressed in time units including seconds, milliseconds, and/or other units. Temporal window component 108 may be configured to obtain temporal window length values that may include a temporal window length generated by a user, a randomly generated temporal window length, and/or otherwise obtained. By way of non-limiting illustration, a first temporal window length may be obtained. Temporal window component 108 may be configured to obtain a second temporal window length.

Temporal window component 108 may be configured to partition one or more audio track durations of one or more audio tracks into multiple temporal windows of one or more temporal window lengths. Individual temporal windows of may span the entirety of the audio track comprised of harmonic sound information obtained via audio track component 106 from the audio wave content of one or more audio tracks. By way of non-limiting illustration, the first audio track may be partitioned into multiple temporal windows of the first temporal window length and of the second temporal windows length. Temporal window component 108 may be configured to partition the second audio track into multiple temporal windows of the first temporal window length and of the second temporal windows length.

Figure 3:
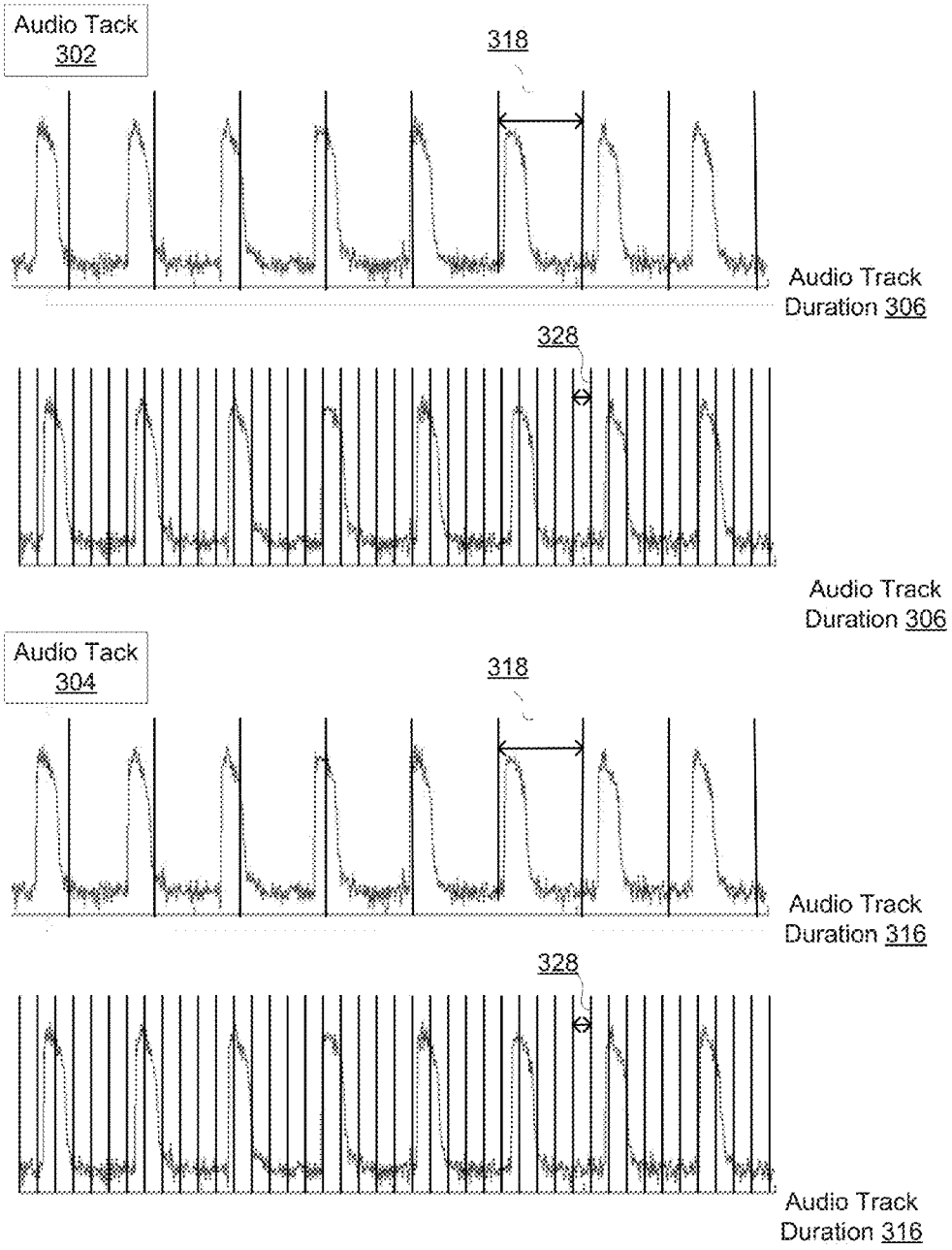
FIG. 3 illustrates an exemplary schematic of partitioning an audio track duration into temporal windows of varying temporal window length, in accordance with one or more implementations.

For example, and as illustrated in FIG. 3, audio track 302 of audio track duration 306 may be partitioned into multiple temporal windows of temporal window length 318. Audio track 302 of audio track duration 306 may be partitioned into multiple temporal windows of temporal window length 328. Audio track 304 of audio track duration 316 may be partitioned into multiple temporal windows of temporal window length 318. Audio track 304 of audio track duration 316 may be partitioned into multiple temporal windows of temporal window length 328. Temporal window length 328 may be different than temporal window length 328.

Figure 2:
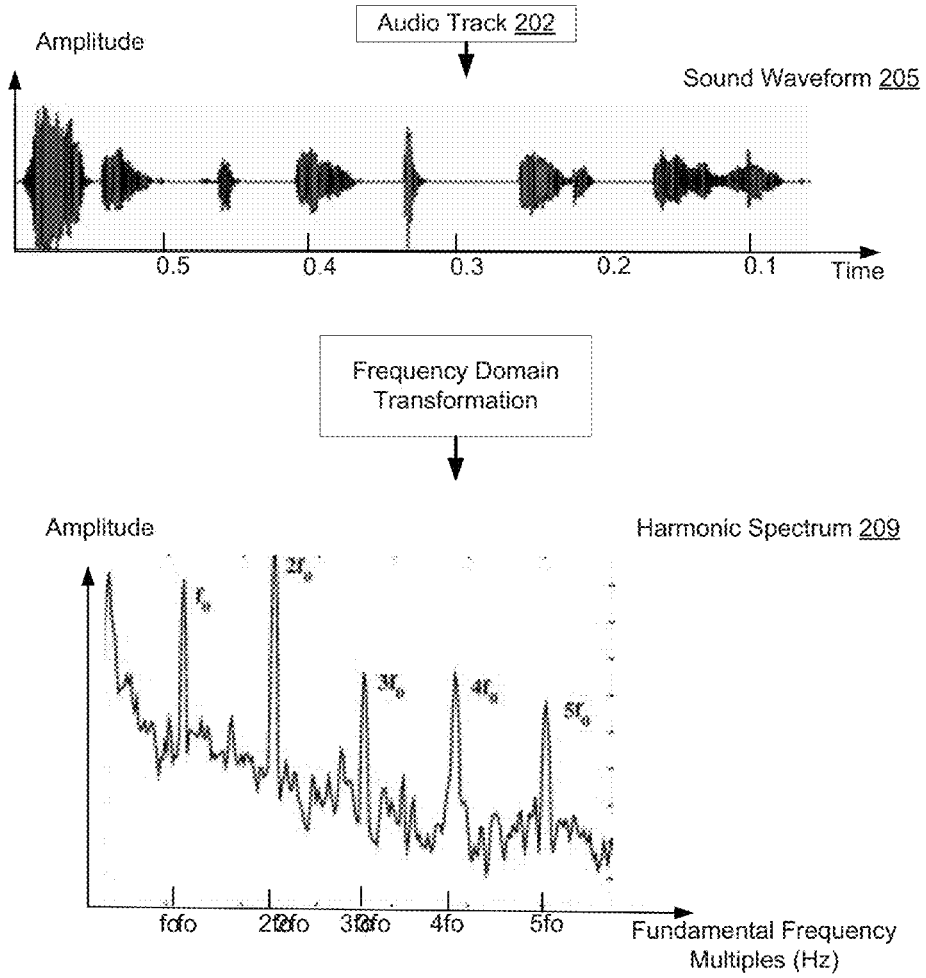
FIG. 2 illustrates an exemplary representation of transforming audio signal into a harmonic spectrum, in accordance with one or more implementations.

Referring back to FIG. 1, transformation component 110 may be configured to determine one or more transformed representations of one or more audio tracks by transforming one or more audio energy tracks for one or more temporal windows into a frequency space in which energy may be represented as a function of frequency to generate a harmonic energy spectrum of the one or more audio tracks. By way of non-limiting illustration, a first transformed representation of the first audio track may be determined by transforming one or more temporal windows of the first temporal window length. Transformation component 110 may be configured to determine a second transformed representation of the first audio track by transforming one or more temporal windows of the second temporal window length. Transformation component 110 may be configured to determine a third transformed representation of the second audio track by transforming one or more temporal windows of the second temporal window length. Transformation component 110 may be configured to determine a fourth transformed representation of the second audio track by transforming one or more temporal windows of the second temporal window length. As illustrated in FIG. 2, waveform 205 of a sound wave of audio track 202 may be transformed to generate a harmonic spectrum. Harmonic spectrum graph 209 tracks one or more of frequency, and/or energy of sound in audio track 202. The horizontal direction of harmonic spectrum 209 represents multiples of fundamental frequency, the vertical direction represents energy. One or more differences between individual one or more multiples of fundamental frequencies may be identified as pitch of the harmonic sound.

Figure 4:
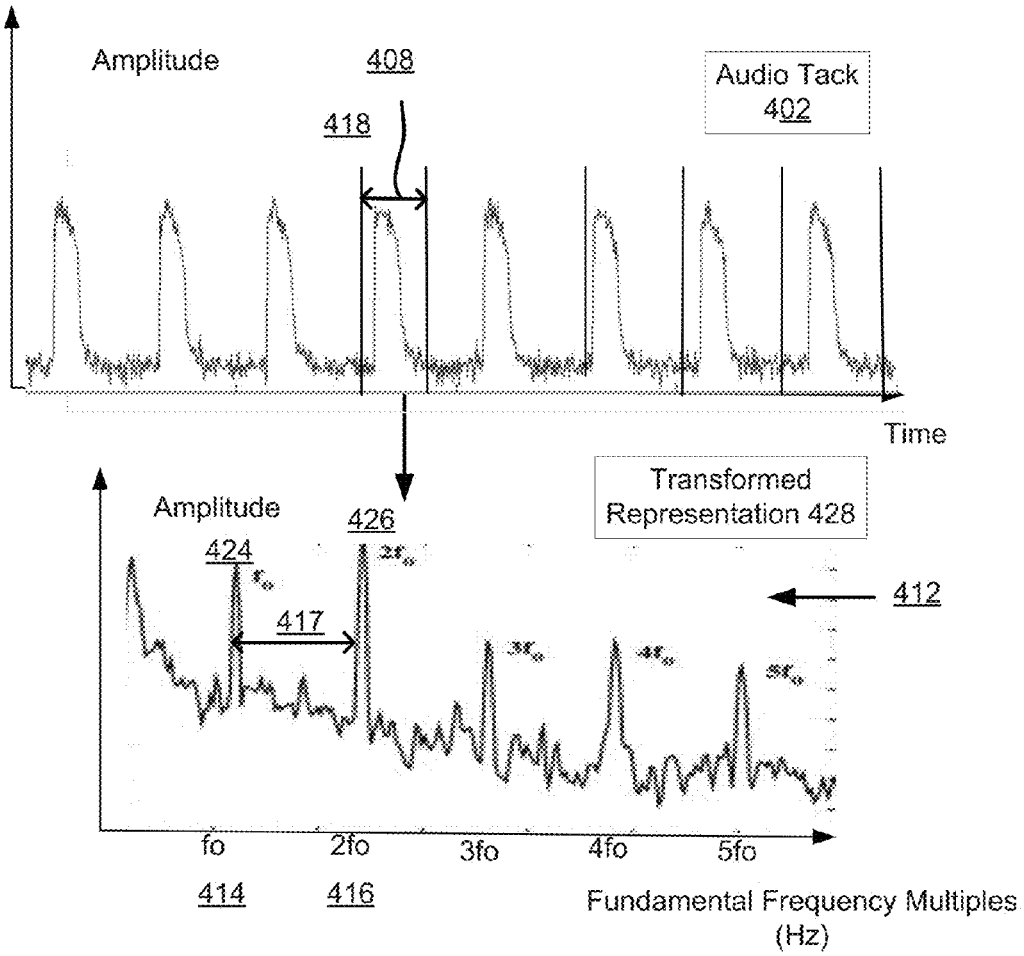
FIG. 4 illustrates an exemplary schematic of obtaining a transformed representation by transforming a temporal window of an audio track, in accordance with one or more implementations.

Referring back to FIG. 1, individual transformed representations for individual temporal windows may be presented as a harmonic spectrum (e.g., an energy-frequency representation) where multiples of fundamental frequencies associated with the transformed signal may be viewed as peaks on the horizontal axis and the corresponding energy on the vertical axis. A frequency associated with a highest energy level may be referred to as a fundamental frequency or a first harmonic of harmonic sound. By way of non-limiting illustration, a first harmonic and a second harmonic of the harmonic sound of one or more transformed representations of one or more temporal windows of one or more temporal window lengths of one or more audio tracks may be determined. For example, and as illustrated in FIG. 4, transformed representation 428 and/or other representations of audio track 402 may be determined by transforming temporal window 418 of temporal window length 408. Transformed representation 428 may be presented as harmonic spectrum 412 including first harmonic 414 and second harmonic 416 and/or other harmonics of the harmonic sound. Second harmonic 416 may be a multiple of fundamental frequency of first harmonic 414.

Referring back to FIG. 1, pitch component 112 may be configured to identify one or more pitches of the harmonic sound of one or more transformed representations for individual temporal windows of one or more temporal window length. By way of non-limiting illustration, a first pitch of the first transformed representation of one or more temporal windows of the first temporal window length of the first audio track may be identified. Pitch component 112 may be configured to determine a second pitch of the second transformed representation of one or more temporal windows of the second temporal window length of the first audio track. Pitch component 112 may be configured to determine a third pitch of the third transformed representation of one or more temporal windows of the first temporal window length of the second audio track. Pitch component 112 may be configured to determine a fourth pitch of the fourth transformed representation of one or more temporal windows of the second temporal window length of the first audio track. For example, and as illustrated in FIG. 4, pitch 417 and/or other pitch values may be identified from transformed representation 428 of temporal window 418 of temporal window length 408 of audio track 402.

Referring back to FIG. 1, Harmonic energy component 114 may be configured to determine magnitudes of harmonic energy at harmonics of the harmonic sound in one or more transformed representations for individual temporal windows of individual temporal window lengths of one or more audio tracks. Individual magnitudes of harmonic energy may be determined for the first harmonic and the second harmonic for individual temporal windows of individual temporal window lengths. A total magnitude of harmonic energy for individual temporal windows may be determined by finding an average of individual magnitudes, a sum of individual magnitudes, and/or otherwise determined. By way of non-limiting illustration, a first magnitude of harmonic energy may be determined for the first transformed representation of one or more temporal windows of the first temporal window length of the first audio track may be determined. Harmonic energy component 114 may be configured to determine a second magnitude of harmonic energy of the second transformed representation of one or more temporal windows of the second temporal window length of the first audio track. Harmonic energy component 114 may be configured to determine a third magnitude of harmonic energy of the third transformed representation of one or more temporal windows of the first temporal window length of the second audio track. Harmonic energy component 114 may be configured to determine a fourth magnitude of harmonic energy of the fourth transformed representation of one or more temporal windows of the second temporal window length of the second audio track.

For example, and as illustrated in FIG. 4, a magnitude of harmonic energy for transformed representation 428 of temporal window 418 of temporal window length 408 of audio track 402 may be determined by determining first energy 424 for first harmonic 414 and second energy 426 for second harmonic 416.

Figure 5:
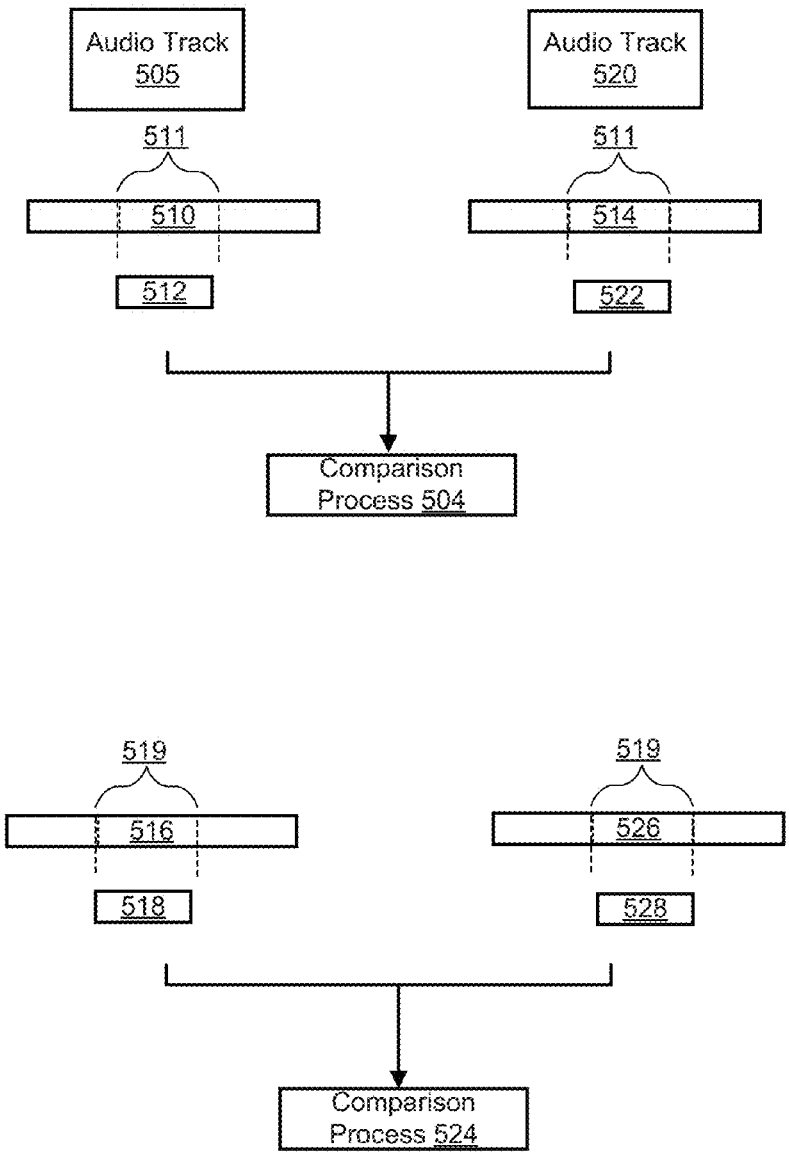
FIG. 5 illustrates an exemplary schematic of a comparison process applied to transformed representations generated from temporal windows of different temporal window lengths from two audio tracks, in accordance with one or more implementations.

Referring back to FIG. 1, comparison component 116 may be configured to compare one or more transformed representations of one or more temporal windows of one or more temporal window length of one or more audio tracks. Specifically, comparison component 116 may be configured to correlate pitch of the harmonic sound and harmonic energy of one or more temporal windows of one or more audio tracks. By way of non-limiting illustration, the first transformed representation of one or more temporal windows of the first temporal window length of the first audio track may be compared against the third transformed representation of one or more temporal windows of the first temporal window length of the second audio track to correlate individual pitch of the harmonic sound and harmonic energy of individual temporal windows. For example, and as illustrated by FIG. 5, comparison process 504 may compare first transformed representation 512 of first temporal window 510 of first temporal window length 511 of the of first audio track 505 against first transformed representation 522 of first temporal window 514 of first temporal window length 511 of second audio track 520.

Referring back to FIG. 1, the process performed by comparison component 116 may be performed iteratively until a result of such comparison is determined. For example, after comparing individual transformed representation of individual temporal windows at the first temporal window length of the first audio track against individual transformed representations of individual temporal windows at the first temporal window length of the second audio track, multiple correlation results may be obtained. The correlation results may be transmitted to system 100 and a determination for the most accurate result may be made.

In some implementations, based on the results obtained from comparing audio tracks at a certain temporal window length, comparison component 116 may be configured to compare one or more transformed representations of one or more temporal windows of the second temporal window length of one or more audio tracks. For example comparison process 524 may compare first transformed representation 518 of first temporal window 516 of second temporal window length 519 of first audio track 505 against first transformed representation 528 of first temporal window 526 of second temporal window length 519 of second energy track 520.

Referring back to FIG. 1, the process performed by comparison component 116 for the second temporal window length may be performed iteratively until a result of such comparison is determined. For example, after comparing individual transformed representation of individual temporal windows at the second temporal window length of the first audio track against individual transformed representations of individual temporal windows at the second temporal window length of the second audio track, multiple correlation results may be obtained. The correlation results may be transmitted to system 100 and a determination for the most accurate result may be made.

In various implementations, comparison component 116 may be configured to apply one or more constraint parameter to control the comparison process. The comparison constraint parameters may include one or more of limiting comparison time, limiting the energy portion, limiting frequency bands, limiting the number of comparison iterations and/or other constrains.

Comparison component 116 may be configured to determine the time it took to compare the first transformed representation of the first audio track against the first transformed representation of the second audio track at the first temporal window length. Time taken to correlate pitch of the harmonic sound and harmonic energy of individual temporal windows of the first audio track against pitch of the harmonic sound and harmonic energy of individual temporal windows of the second audio track may be transmitted to system 100. Comparison component 116 may utilize the time taken to correlate pitch of the harmonic sound and harmonic energy of individual temporal windows at a particular temporal window length in subsequent comparison iterations. For example, time taken to compare transformed representations at a longer temporal window length may be equal to 5 seconds. Comparison component 116 may be configured to limit the next comparison iteration at a smaller temporal window length to 5 seconds. In one implementation, the time taken to compare two transformed representations may be utilized by the other constraint comparison parameters and/or used as a constant value.

Comparison component 116 may be configured to limit the audio track duration of one or more audio tracks during the comparison process by applying a comparison window set by a comparison window parameter. Comparison component 116 may be configured to limit the audio track duration of one or more audio track being compared by applying the comparison window parameter (i.e., by setting a comparison window). The comparison window parameter may include a time of audio track duration to which the comparison may be limited, a position of the comparison window, including a start position and an end position, and/or other constrains. This value may be predetermined by system 100, set by a user, and/or otherwise obtained.

In some implementation, comparison component 116 may be configured to limit the audio track duration such that the comparison window parameter may not be greater than 50 percent of the audio track duration. For example, if an audio track is 500 seconds then the length of the comparison window set by the comparison window parameter may not be greater than 250 seconds.

The comparison window parameter may have a predetermined start position that may be generated by system 100 and/or may be based on user input. System 100 may generate a start position of the comparison window based on the audio track duration. For example, the start position may be randomly set to the initial one third of the audio track duration. In some implementations, the user may generate the start position of the comparison window based on specific audio features of the audio track. For example, user may know that a first audio track and a second audio track may contain audio features that represent sound captured at the same football game, specifically first touchdown of the game. Audio features associated with the touchdown may be used to generate the start position of the comparison window.

Comparison component 116 may be configured to limit one or more portions of one or more audio track during the comparison process based on the comparison window parameter during every comparison iteration. Comparison component 116 may be configured to limit the comparison process to the same portion of one or more audio tracks. Alternatively, in some implementations, comparison component 116 may be configured to limit the comparison process to different portions of one or more audio tracks based on the comparison window parameter during individual comparison iteration. For example, the comparison window parameter may be generated every time the comparison of the audio tracks at a specific temporal window length is performed. In other words, the start position of the comparison window parameter may be different with every comparison iteration irrespective of the start position of the comparison window parameter at the previous resolution level.

Comparison component 116 may be configured to limit the number of comparison iterations based on a correlation threshold parameter. Comparison component 116 may be configured to generate a correlation coefficient based on a result of a first comparison that may identify correlated pitch of the harmonic sound and harmonic energy of individual temporal windows. Comparison component 116 may be configured to obtain a threshold value. The threshold value may be generated by system 100, may be set by a user, and/or obtained by other means. Comparison component 116 may be configured to compare the correlation coefficient against the threshold value. Comparison component 116 may be configured to stop the comparison when the correlation coefficient falls below the threshold value.

In some implementations, comparison component 116 may be configured to compare pitch of the harmonic sound and harmonic energy of individual temporal windows of the first audio track against pitch of the harmonic sound and harmonic energy of individual temporal windows of the second audio track within the multi-resolution framework, which is incorporated by reference.

For example, comparison component 116 may be configured to compare individual transformed representations of one or more temporal windows of the first audio track against individual transformed representations of one or more temporal windows of the second audio track at a mid-resolution level. Pitch of the harmonic sound and harmonic energy of individual temporal windows of the first audio track at the mid-resolution level may be compared against pitch of the harmonic sound and harmonic energy of individual temporal windows of the second audio track at the mid-resolution level to correlate pitch values and harmonic energy values between the first audio track and the second audio track. The result of a first comparison may identify correlated pitch and harmonic energy values from the first and second audio tracks that may represent energy in the same sound. The result of first comparison may be transmitted to system 100 after the first comparison is completed.

The second comparison may be performed at a level of resolution that may be higher than the mid-resolution level. Pitch of the harmonic sound and harmonic energy of individual temporal windows of the first audio track of the first energy track at the higher resolution level may be compared against pitch of the harmonic sound and harmonic energy of individual temporal windows of the first audio track of the second energy track at the higher resolution level. The result of the second comparison may be transmitted to system 100.

This process may be iterative such that comparison component 116 may compare pitch of the harmonic sound and harmonic energy of individual temporal windows of the first audio track against pitch of the harmonic sound and harmonic energy of individual temporal windows of the first audio track of the second energy track at every resolution level whereby increasing the resolution with individual iteration until the highest level of resolution is reached. For example, if the number of resolution levels within individual energy track is finite, comparison component 116 may be configured to compare transformed representations at a mid-resolution level first, then, at next iteration, comparison component 116 may be configured to compare frequency energy resolutions at a resolution level higher than the resolution level of previous iteration, and so on. The last iteration may be performed at the highest resolution level. System 100 may accumulate a number of transmitted correlation results obtained from comparison component 116. The correlation results may be transmitted to system 100 and a determination for the most accurate result may be made.

Temporal alignment component 118 may be configured to determine a temporal alignment estimate between multiple audio tracks. By way of non-limiting illustration, temporal alignment component 118 may be configured to determine a temporal alignment estimate between multiple audio tracks based on the results of comparing one or more transformed representation generated by transformation component 112 via comparison component 114 to correlate pitch of the harmonic sound identified by pitch component 112 and harmonic energy determined by harmonics component 114 of individual temporal windows, and/or based on other techniques. The temporal alignment estimate may reflect an offset in time between a commencement of sound on one or more audio tracks.

Temporal alignment component 118 may be configured to identify matching pitch of the harmonic sound and harmonic energy of transformed representations of one or more temporal windows of individual temporal windows length of individual audio tracks. Temporal alignment component 118 may identify matching pitch of the harmonic sound and harmonic energy from individual comparison iteration via comparison component 116. Temporal alignment component 118 may be configured to calculate a $\Delta t$, or time offset value, based on a position of the matching energy samples within the corresponding frequency energy representations.

In some implementations, temporal alignment component 118 may be configured to determine multiple temporal alignment estimates between the first audio track and the second audio track. Individual temporal alignment estimates may be based on comparing individual transformed representations of one or more temporal windows of individual audio tracks via comparison component 116, as described above. Temporal alignment component 118 may be configured to assign a weight to individual temporal alignment estimates. Temporal alignment component 118 may be configured to determine a final temporal alignment estimate by computing weighted averages of multiple temporal alignment estimates and/or by performing other computations.

In some implementations, temporal alignment component 118 may be configured to use individual playback rates associated with individual audio tracks when determining the temporal alignment estimate. Using individual playback rates as a factor in determining audio track alignment may correct a slight difference in sample clock rates associated with equipment on which audio tracks may have been recorded. For example, multiple individual temporal alignment estimates may be analyzed along with individual playback rates of each audio track. A final temporal alignment estimate may be computed by taking into account both individual temporal alignment estimates and playback rates and/or other factors. A liner correction approach and/or other approach may be taken.

Synchronizing component 120 may be configured to synchronize one or more audio tracks. By way of non-limiting illustration, synchronizing component 120 may be configured to use comparison results obtained via comparison component 116 of comparing one or more transformed representations of one or more temporal windows of one or more audio tracks, and/or using other techniques. Synchronizing component 120 may be configured to synchronize the first audio track with the second audio track based on the temporal alignment estimate. In some implementations, the time offset between the energy tracks may be used to synchronize individual audio tracks by aligning the audio tracks based on the time offset calculation.

Referring again to FIG. 1, in some implementations, a user may generate a first media file containing both video and audio components. User may generate a second media file containing audio component corresponding to the same live occurrence. User may want to synchronize first media file with second media file. For example, a group of friends may record a video of them singing a musical composition. They may wish to overlay an audio component of the same musical composition they or another user performed earlier in the studio with the video file. By synchronizing the video file with the pre-recorded audio file users obtain a video file that contains a pre-recorded audio component overlaid over the video component.

In some implementations, system 100 may synchronize media files from three, four, five, or more media capture devices (not illustrated) capturing the same live occurrence. Users capturing live occurrence simultaneously may be located near or away from each other and may make recordings from various perspectives.

In some implementations, the plurality of media files may be generated by the same user. For example, a user may place multiple media recording devices around himself to record himself from various perspectives. Similarly, a film crew may generate multiple media files during a movie shoot of the same scene.

Referring again to FIG. 1, in some implementations, server(s) 102, client computing platform(s) 104, and/or external resources 120 may be operatively linked via one or more electronic communication links. For example, such electronic communication links may be established, at least in part, via a network such as the Internet and/or other networks. It will be appreciated that this is not intended to be limiting, and that the scope of this disclosure includes implementations in which server(s) 102, client computing platform(s) 104, and/or external resources 120 may be operatively linked via some other communication media.

A given client computing platform 104 may include one or more processors configured to execute computer program components. The computer program components may be configured to enable a producer and/or user associated with the given client computing platform 104 to interface with system 100 and/or external resources 120, and/or provide other functionality attributed herein to client computing platform(s) 104. By way of non-limiting example, the given client computing platform 104 may include one or more of a desktop computer, a laptop computer, a handheld computer, a NetBook, a Smartphone, a gaming console, and/or other computing platforms.

External resources 120 may include sources of information, hosts and/or providers of virtual environments outside of system 100, external entities participating with system 100, and/or other resources. In some implementations, some or all of the functionality attributed herein to external resources 120 may be provided by resources included in system 100.

Server(s) 102 may include electronic storage 122, one or more processors 124, and/or other components. Server(s) 102 may include communication lines, or ports to enable the exchange of information with a network and/or other computing platforms. Illustration of server(s) 102 in FIG. 1 is not intended to be limiting. Servers(s) 102 may include a plurality of hardware, software, and/or firmware components operating together to provide the functionality attributed herein to server(s) 102. For example, server(s) 102 may be implemented by a cloud of computing platforms operating together as server(s) 102.

Electronic storage 122 may include electronic storage media that electronically stores information. The electronic storage media of electronic storage 122 may include one or both of system storage that is provided integrally (i.e., substantially non-removable) with server(s) 102 and/or removable storage that is removably connectable to server(s) 102 via, for example, a port (e.g., a USB port, a firewire port, etc.) or a drive (e.g., a disk drive, etc.). Electronic storage 122 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. The electronic storage 122 may include one or more virtual storage resources (e.g., cloud storage, a virtual private network, and/or other virtual storage resources). Electronic storage 122 may store software algorithms, information determined by processor(s) 124, information received from server(s) 102, information received from client computing platform(s) 104, and/or other information that enables server(s) 102 to function as described herein.

Processor(s) 124 may be configured to provide information processing capabilities in server(s) 102. As such, processor(s) 124 may include one or more of a digital processor, an analog processor, a digital circuit designed to process information, an analog circuit designed to process information, a state machine, and/or other mechanisms for electronically processing information. Although processor(s) 124 is shown in FIG. 1 as a single entity, this is for illustrative purposes only. In some implementations, processor(s) 124 may include a plurality of processing units. These processing units may be physically located within the same device, or processor(s) 124 may represent processing functionality of a plurality of devices operating in coordination. The processor(s) 124 may be configured to execute computer readable instruction components 106, 108, 110, 112, 114, 116, 118, 120 and/or other components. The processor(s) 124 may be configured to execute components 106, 108, 110, 112, 114, 116, 118, 120 and/or other components by software; hardware; firmware; some combination of software, hardware, and/or firmware; and/or other mechanisms for configuring processing capabilities on processor(s) 124.

It should be appreciated that although components 106, 108, 110, 112, 114, 116, 118 and 120 are illustrated in FIG. 1 as being co-located within a single processing unit, in implementations in which processor(s) 124 includes multiple processing units, one or more of components 106, 108, 110, 112, 114, 116, 118 and/or 120 may be located remotely from the other components. The description of the functionality provided by the different components 106, 108, 110, 112, 114, 116, 118 and/or 120 described herein is for illustrative purposes, and is not intended to be limiting, as any of components 106, 108, 110, 112, 114, 116, 118 and/or 120 may provide more or less functionality than is described. For example, one or more of components 106, 108, 110, 112, 114, 116, 118 and/or 120 may be eliminated, and some or all of its functionality may be provided by other ones of components 106, 108, 110, 112, 114, 116, 118 and/or 120. As another example, processor(s) 124 may be configured to execute one or more additional components that may perform some or all of the functionality attributed herein to one of components 106, 108, 110, 112, 114, 116, 118 and/or 120.

Figure 6:
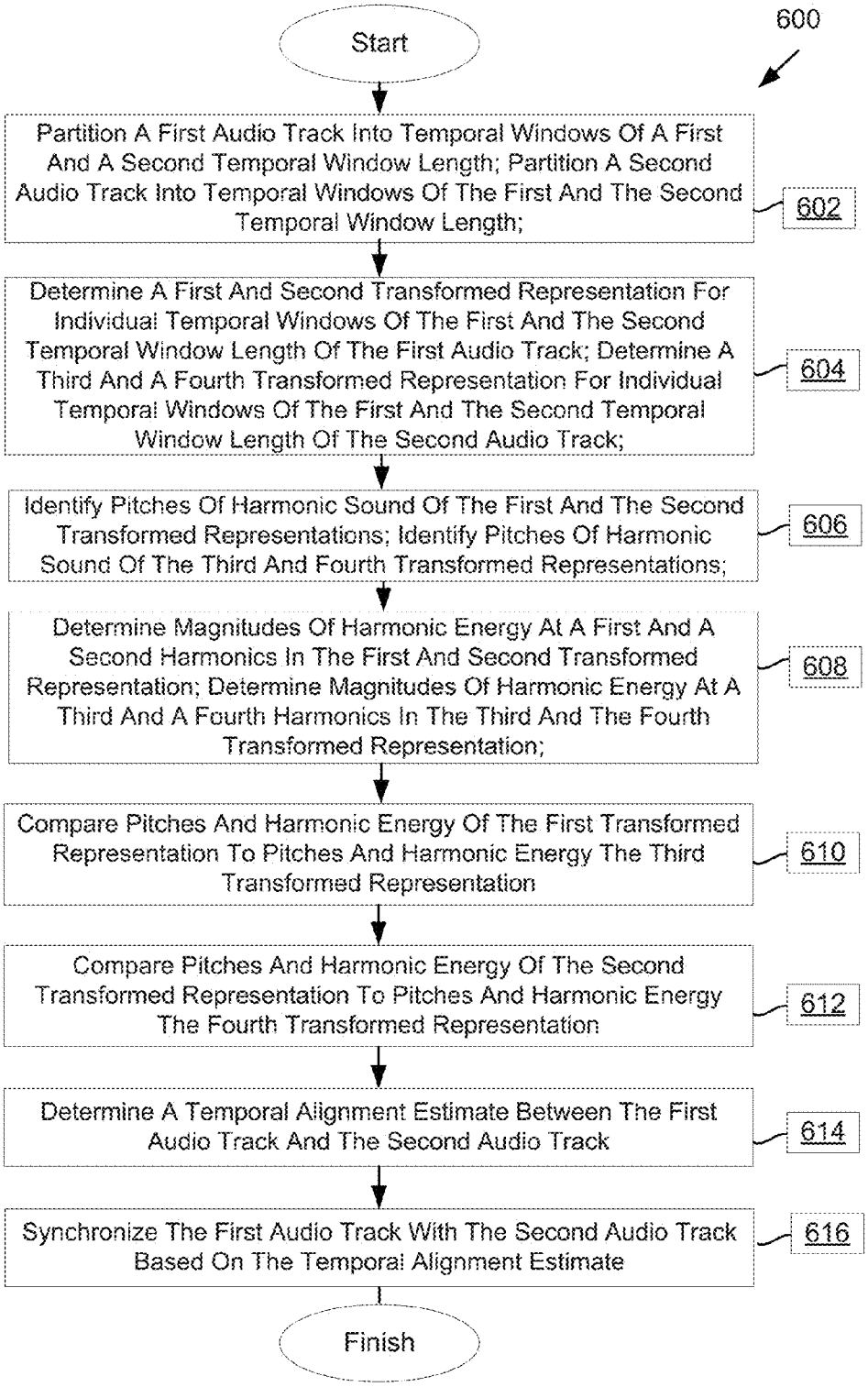
FIG. 6 illustrates a method for synchronizing video files using harmonics of the harmonic sound, in accordance with one or more implementations.

FIG. 6 illustrates a method 600 for synchronizing video files using harmonics of the harmonic sound, in accordance with one or more implementations. The operations of method 600 presented below are intended to be illustrative. In some implementations, method 600 may be accomplished with one or more additional operations not described, and/or without one or more of the operations discussed. Additionally, the order in which the operations of method 600 are illustrated in FIG. 6 and described below is not intended to be limiting.

In some implementations, method 600 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 600 in response to instructions stored electronically on an electronic storage medium. The one or more processing devices may include one or more devices configured through hardware, firmware, and/or software to be specifically designed for execution of one or more of the operations of method 600.

At an operation 602, a first audio track may be partitioned into individual temporal windows of a first and a second temporal window length and/or a second audio track may be partitioned into individual temporal windows of a first and a second temporal window. Operation 602 may be performed by one or more physical processors executing a temporal window component that is the same as or similar to temporal window component 108, in accordance with one or more implementations.

At an operation 604, a first and a second transformed representation for individual temporal windows of a first and a second temporal window length of the first audio track may be determined and/or a third and a fourth transformed representation for individual temporal windows of a first and a second temporal window length of the second audio track may be determined. Operation 604 may be performed by one or more physical processors executing a transformation component that is the same as or similar to transformation component 110, in accordance with one or more implementations.

At an operation 606, pitches of harmonic sound of the first and the second transformed representations may be identified and/or pitches of harmonic sound of the third and fourth transformed representations may be identified. Operation 606 may be performed by one or more physical processors executing a pitch component that is the same as or similar to pitch component 112, in accordance with one or more implementations.

At an operation 608, magnitudes of harmonic energy at a first and a second harmonics in the first and the second transformed representations may be identified and/or pitches of harmonic sound of the third and fourth transformed representations may be identified. Operation 608 may be performed by one or more physical processors executing a harmonics component that is the same as or similar to harmonics component 114, in accordance with one or more implementations.

At an operation 610, pitches and harmonic energy of the first transformed representation may be compared be to pitches and harmonic energy of the third transformed representation. At an operation 612, pitches and harmonic energy of the second transformed representation may be compared be to pitches and harmonic energy of the third transformed representation. Operations 610 and 612 may be performed by one or more physical processors executing a comparison component that is the same as or similar to comparison component 116, in accordance with one or more implementations.

At an operation 614, a temporal alignment estimate between the first audio track and the second audio track based on the comparison of the first transformed representation to the third transformed representation and the second transformed representation to the fourth transformed representation may be determined. Operation 614 may be performed by one or more physical processors executing a temporal alignment component that is the same as or similar to temporal alignment 118, in accordance with one or more implementations.

At an operation 616, a synchronization of the first audio track with the second audio track based on the temporal alignment estimate of the first audio representation and the second audio representation may be performed. Operation 616 may be performed by one or more physical processors executing a synchronizing component that is the same as or similar to synchronizing component 120, in accordance with one or more implementations.

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

Although the invention has been described in detail for the purpose of illustration based on what is currently considered to be the most practical and preferred implementations, it is to be understood that such detail is solely for that purpose and that the invention is not limited to the disclosed implementations, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A method for synchronizing audio tracks, comprising:

obtaining two audio tracks, individual audio tracks having a track duration and representing individual audio content recorded over the track duration of the individual audio tracks, the individual audio content including harmonic sound having multiple harmonics;

obtaining two temporal window lengths, the two temporal window lengths being different;

partitioning the track durations of the two audio tracks into multiple temporal windows of the two temporal window lengths;

determining four transformed representations of the two audio tracks by transforming individual temporal windows of the two audio tracks into frequency space in which energy is represented as a function of frequency;

identifying pitches of harmonic sound in the four transformed representations such that pitch of the harmonic sound in the individual audio content is determined for individual temporal windows of the two temporal window lengths;

determining magnitudes of harmonic energy at harmonics of the harmonic sound in the four transformed representations such that magnitude of energy is determined for the multiple harmonics for individual temporal windows of the two temporal window lengths;

comparing a first pair of the transformed representations of the two audio tracks to correlate pitch of the harmonic sound and harmonic energy of individual temporal windows in the first pair of the transformed representations of the two audio tracks, the correlated pitch and harmonic energy being identified as potentially representing energy in the same sounds;

comparing a second pair of the transformed representations for at least one individual temporal window of the two audio tracks to correlate pitch of the harmonic sound and harmonic energy in the individual windows of the second pair of the transformed representations of the two audio tracks, the second pair of the transformed representations being selected for the comparison based on the correlation of pitch of the harmonic sound and harmonic energy between the first pair of the transformed representations;

determining, from the correlations of pitch of the harmonic sound and harmonic energy, a temporal alignment estimate between the two audio tracks, the temporal alignment estimate reflecting an offset in time between commencement of sound in the two audio tracks; and synchronizing the two audio tracks based on the temporal alignment estimate.

2. The method of claim 1, wherein magnitude of energy is determined for the multiple harmonics for individual temporal windows of a given temporal window length by computing an average of individual energies associated with the multiple harmonics.

3. The method of claim 1, further comprising:

selecting a comparison window to portions of the two audio tracks, the comparison window having a start position and an end position.

4. The method of claim 3, wherein the start position of the comparison window is determined based on specific audio features of the two audio tracks.

5. The method of claim 1, further comprising:

obtaining a temporal alignment threshold;

comparing the temporal alignment estimate with the temporal alignment threshold; and determining whether to continue comparing transformation representations for at least one individual temporal window of the two audio tracks based on the comparison of the temporal alignment estimate and the temporal alignment threshold.

6. The method of claim 5, wherein determining whether to continue comparing the transformed representations includes determining to not continue comparing the transformed representations in response to the temporal alignment estimate being smaller than the temporal alignment threshold.

7. The method of claim 1, further comprising:

determining whether to continue comparing transformed representations for at least one individual temporal window of the two audio tracks by assessing whether a stopping criteria has been satisfied, such determination being based on the temporal alignment estimate and the stopping criteria.

8. The method of claim 7, wherein the stopping criteria is satisfied by multiple, consecutive determinations of the temporal alignment estimate falling within a specific range or ranges.

9. The method of claim 8, wherein the specific range or ranges are bounded by a temporal alignment threshold or thresholds.

10. The method of claim 1, wherein the two audio tracks are generated from different media files, the different media files individually including audio and video information.

11. A system for synchronizing audio tracks, comprising:

one or more physical processors configured by computer-readable instructions to:

obtain two audio tracks, individual audio tracks having a track duration and representing individual audio content recorded over the track duration of the individual audio tracks, the individual audio content including harmonic sound having multiple harmonics;

obtain two temporal window lengths, the two temporal window lengths being different;

partition the track durations of the two audio tracks into multiple temporal windows of the two temporal window lengths;

determine four transformed representations of the two audio tracks by transforming individual temporal windows of the two audio tracks into frequency space in which energy is represented as a function of frequency;

identify pitches of harmonic sound in the four transformed representations such that pitch of the harmonic sound in the individual audio content is determined for individual temporal windows of the two temporal window lengths;

determine magnitudes of harmonic energy at harmonics of the harmonic sound in the four transformed representations such that magnitude of energy is determined for the multiple harmonics for individual temporal windows of the two temporal window lengths;

compare a first pair of the transformed representations of the two audio tracks to correlate pitch of the harmonic sound and harmonic energy of individual temporal windows in the first pair of the transformed representations of the two audio tracks, the correlated pitch and harmonic energy being identified as potentially representing energy in the same sounds;

compare a second pair of the transformed representations for at least one individual temporal window of the two audio tracks to correlate pitch of the harmonic sound and harmonic energy in the individual windows of the second pair of the transformed representations of the two audio tracks, the second pair of the transformed representations being selected for the comparison based on the correlation of pitch of the harmonic sound and harmonic energy between the first pair of the transformed representations;

determine, from the correlations of pitch of the harmonic sound and harmonic energy, a temporal alignment estimate between the two audio tracks, the temporal alignment estimate reflecting an offset in time between commencement of sound in the two audio tracks; and synchronize the two audio tracks based on the temporal alignment estimate.

12. The system of claim 11, wherein magnitude of energy is determined for the multiple harmonics for individual temporal windows of a given temporal window length by computing an average of individual energies associated with the multiple harmonics.

13. The system of claim 11, wherein the one or more physical processors are further configured to:

select a comparison window to portions of the two audio tracks, the comparison window having a start position and an end position.

14. The system of claim 13, wherein the start position of the comparison window is determined based on specific audio features of the two audio tracks.

15. The system of claim 11, wherein the one or more physical processors are further configured to:

obtain a temporal alignment threshold;

compare the temporal alignment estimate with the temporal alignment threshold; and determine whether to continue comparing transformation representations for at least one individual temporal window of the two audio tracks based on the comparison of the temporal alignment estimate and the temporal alignment threshold.

16. The system of claim 15, wherein determining whether to continue comparing the transformed representations includes determining to not continue comparing the transformed representations in response to the temporal alignment estimate being smaller than the temporal alignment threshold.

17. The system of claim 11, wherein the one or more physical processors are further configured to:

determine whether to continue comparing transformed representations for at least one individual temporal window of the two audio tracks by assessing whether a stopping criteria has been satisfied, such determination being based on the temporal alignment estimate and the stopping criteria.

18. The system of claim 17, wherein the stopping criteria is satisfied by multiple, consecutive determinations of the temporal alignment estimate falling within a specific range or ranges.

19. The system of claim 18, wherein the specific range or ranges are bounded by a temporal alignment threshold or thresholds.

20. The system of claim 11, wherein the two audio tracks are generated from different media files, the different media files individually including audio and video information.

* * * * *